US007219448B2

(12) United States Patent
Cheng

(10) Patent No.: US 7,219,448 B2
(45) Date of Patent: May 22, 2007

(54) HEALTH PROMOTING INSOLE

(75) Inventor: Sen-Mei Cheng, Changhua Hsien (TW)

(73) Assignee: Taiwan Paiho Limited, Changhua Hsien (TW)

( * ) Notice: Subject to any disclaimer, the term of this patent is extended or adjusted under 35 U.S.C. 154(b) by 293 days.

(21) Appl. No.: 10/852,173

(22) Filed: May 25, 2004

(65) Prior Publication Data

US 2005/0262735 A1 Dec. 1, 2005

(51) Int. Cl.
*A43B 13/38* (2006.01)

(52) U.S. Cl. ..... 36/44; 36/71; 36/141

(58) Field of Classification Search ..... 36/43, 36/44, 71, 141; 12/142 R, 146 R
See application file for complete search history.

(56) References Cited

U.S. PATENT DOCUMENTS 6,131,311 A * 10/2000 Brown et al. ..... 36/43
6,680,289 B1 * 1/2004 Woo et al. ..... 510/470
6,699,917 B2 * 3/2004 Takashima ..... 521/174
2004/0147416 A1 * 7/2004 Woo et al. ..... 510/101

FOREIGN PATENT DOCUMENTS

JP 2002223809 A * 8/2002
JP 2003334104 A * 11/2003

* cited by examiner

*Primary Examiner*—Jila M Mohandesi
(74) *Attorney, Agent, or Firm*—Troxell Law Office, PLLC

(57) ABSTRACT

A health-promoting insole includes bamboo charcoal powder mixed with filament fibers. Via the bamboo charcoal powder added at the upper and bottom layers of the insole, the insole thereof is equipped with strong moisture absorbent capabilities as well as anti-bacteria and deodorization effects.

4 Claims, 5 Drawing Sheets

5% of bamboo charcoal powder and 95% of filament fibers are mixed before closely knitted and drawn into an upper layer with a plurality of hollow support rings densely arranged at the upper surface thereon

↓

Bamboo vinegar liquid and bamboo charcoal powder in a ratio of 1 to 2 are mixed up and heated dry in 48 hours.

↓

Foaming material in a percentage of 5 to 10 % is added into the mixture of bamboo vinegar liquid and bamboo charcoal powder after heated dry in 48 hours, and further processed into a bottom layer of a proper thickness.

↓

The upper and bottom layers are mutually bound together at the corresponding sides via fastening agent before pressed into insoles of various sizes and shoe shapes; thus, via the bamboo charcoal powder added at the upper and bottom layers therein, the insole thereof is equipped with strong absorbing and decomposing capabilities as well as anti-bacteria, humid-adjustment, and deodorization effects. Besides, far-infrared radiation proper for the absorption of human body is generated to speed up blood circulation and improve the health of human body, and healthy negative ions is increased in the air to balance the humidity at the interior of shoes and prevent bugs therein, efficiently promoting the quality of the insole thereof to achieve better deodorization and anti-bacteria effects thereof.

FIG. 2

HEALTH PROMOTING INSOLE

BACKGROUND OF THE INVENTION

The present invention is related to a health-promoting insole, including an upper layer with hollow support rings densely arranged thereon, a bottom layer, and bamboo charcoal powder added at the upper and bottom layers therein respectively wherein the upper and bottom layers are mutually bound together via fastening agent and pressed into insoles of various sizes and shoe shapes; whereby, the insole thereof is equipped with strong absorbing and decomposing capabilities as well as anti-bacteria, humid-adjustment, and deodorization effects.

A conventional insole for shoes is not equipped with anti-bacteria or strong moisture absorbing and deodorizing capabilities. Though designed with an airy effect, the conventional insole is unable to adjust humidity and defeat bugs. Once shoes are taken off after a long time of wearing, the conventional insoles therein easily disperse a bad smell of feet. Therefore, such a conventional insole for shoes, which is rather poor in deodorization, is significantly reduced in the quality thereof.

SUMMARY OF THE PRESENT INVENTION

It is, therefore, the primary purpose of the present invention to provide a health-promoting insole, including an upper layer and a bottom layer with bamboo charcoal powder added therein respectively; whereby, via the bamboo charcoal powder added therein, the insole thereof is equipped with strong moisture absorbing capabilities as well as anti-bacteria, humid-adjustment, and deodorization effects.

It is, therefore, the second purpose of the present invention to provide a health-promoting insole wherein hollow support rings are densely arranged at the surface of the upper layer thereon to sustain the weight of sole pressed downwards onto the insole thereof and to generate a massage and airy effect thereby.

BRIEF DESCRIPTION OF THE DRAWINGS

FIG. 2 is a flow chart of the present invention.

DETAILED DESCRIPTION OF THE PREFERRED EMBODIMENTS

Figure 1:
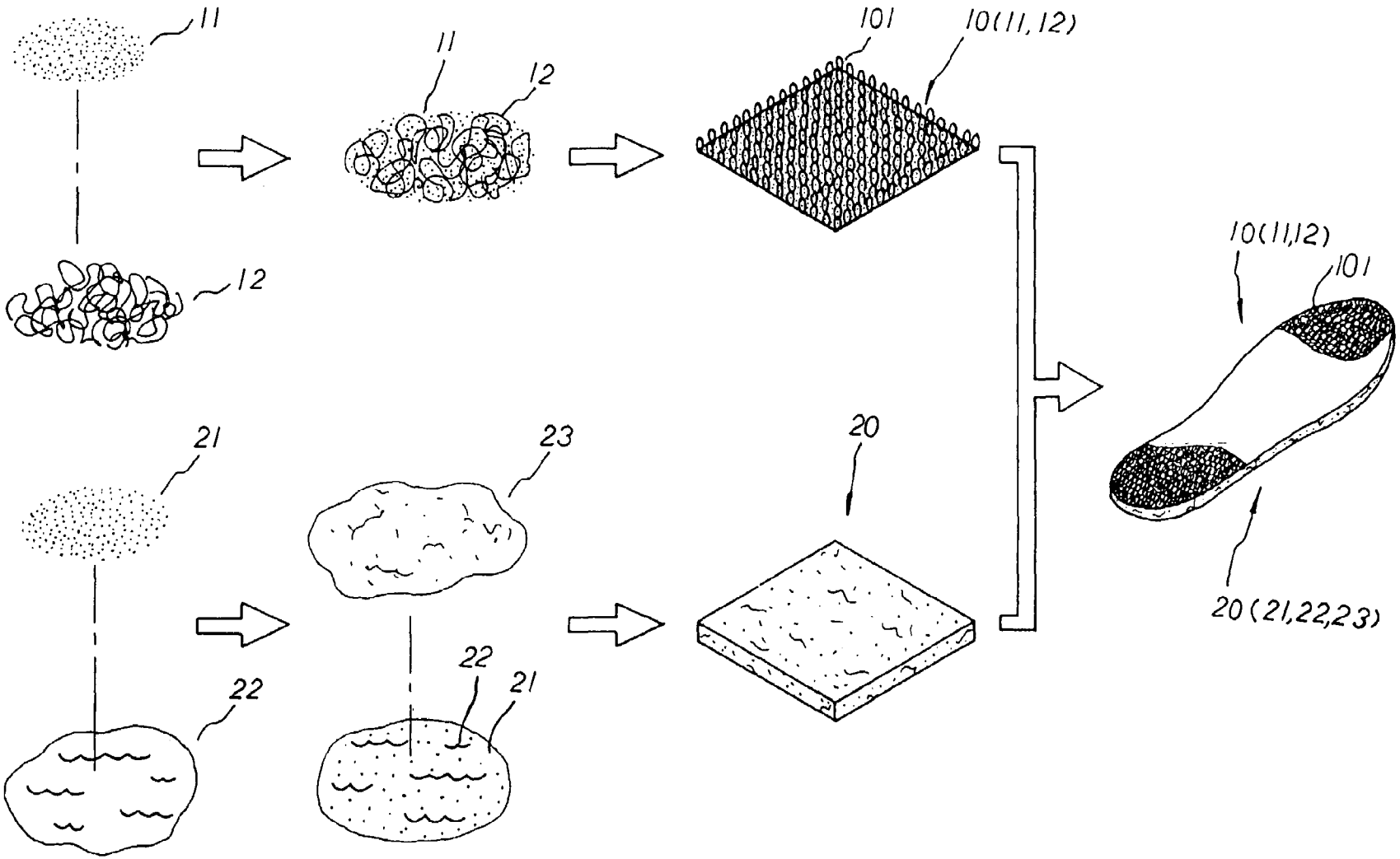
FIG. 1 is a perspective flow graph of the present invention.
Figure 5:
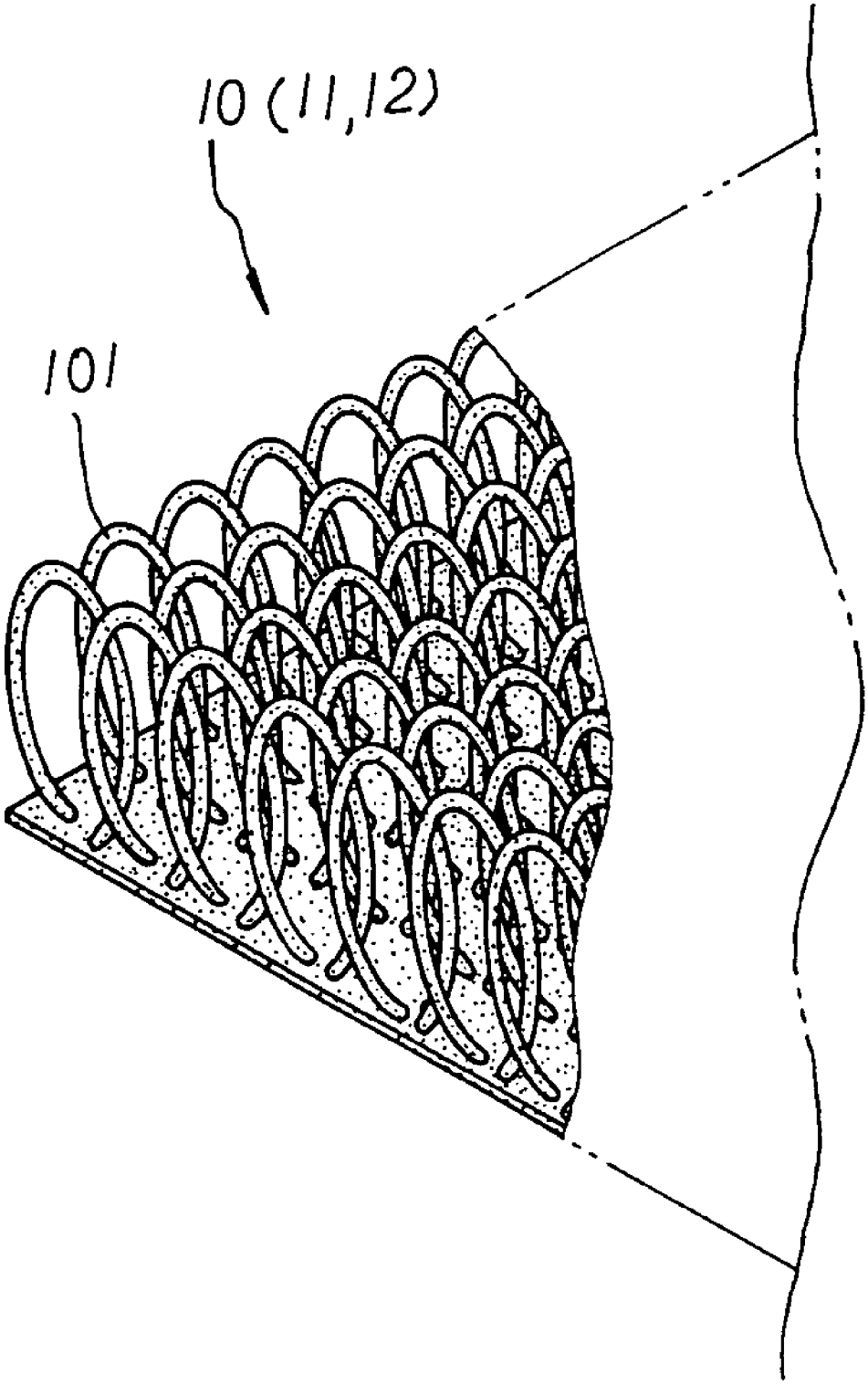
FIG. 5 is a partially enlarged view of an upper layer of the present invention.

Please refer to FIG. 1 showing a perspective flow graph of the present invention (accompanied by FIG. 2 showing a flow chart of the present invention). The present invention is related to a health-promoting insole that is, in a preferred embodiment, is processed in the steps as follows;

A. Bamboo charcoal powder 11 in a percentage of 5% is mixed with 95% of filament fibers 12 (especially oxford single filament) before the mixture thereof is closely knitted and drawn into an upper layer 10 with a plurality of hollow support rings 101 densely arranged at the upper surface thereon as shown in FIG. 5.

B. Bamboo vinegar liquid 21 and bamboo charcoal powder 22 in a ratio of 1 to 2 are mixed up and heated to dry in 48 hours.

C. Foaming material 23 (especially EVA or PU foaming material) in a percentage of 5 to 10% is added into the mixture of bamboo vinegar liquid 21 and bamboo charcoal powder 22 after heated to dry in 48 hours to be further processed into a bottom layer 20 of a proper thickness.

Figure 3:
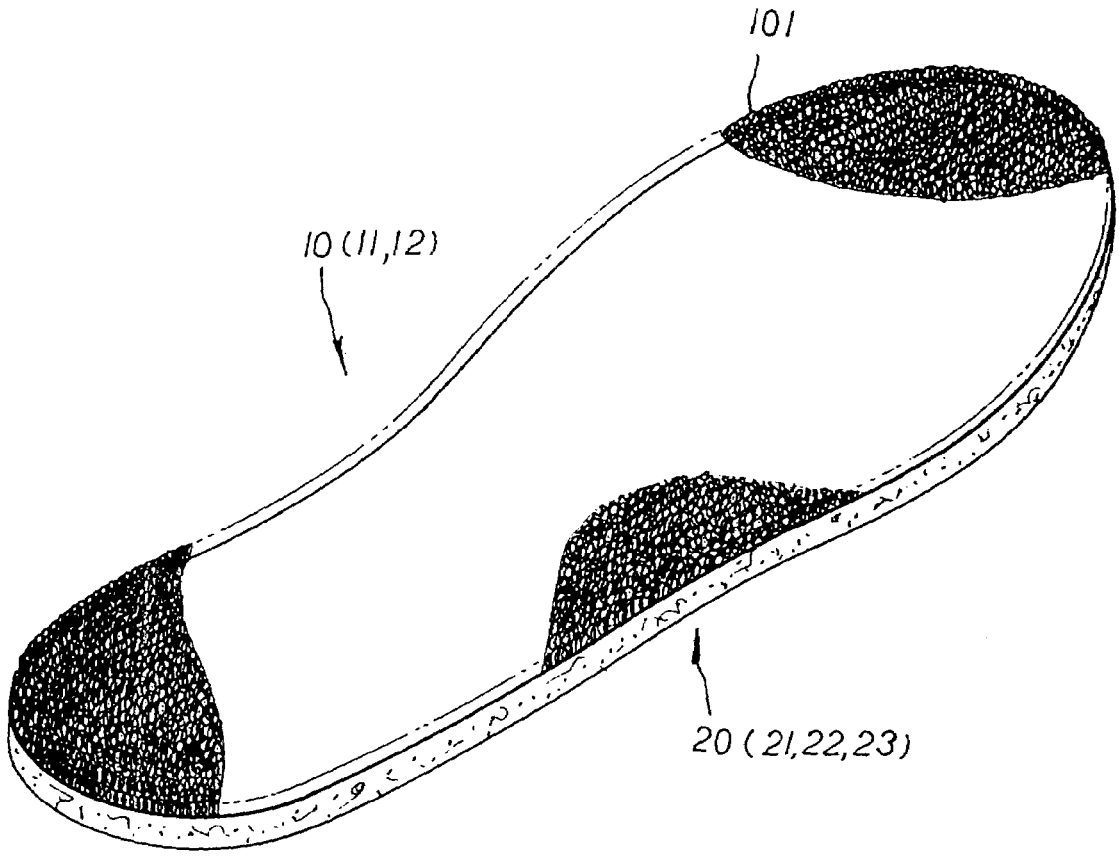
FIG. 3 is a perspective view of the present invention in assembly.
Figure 4:
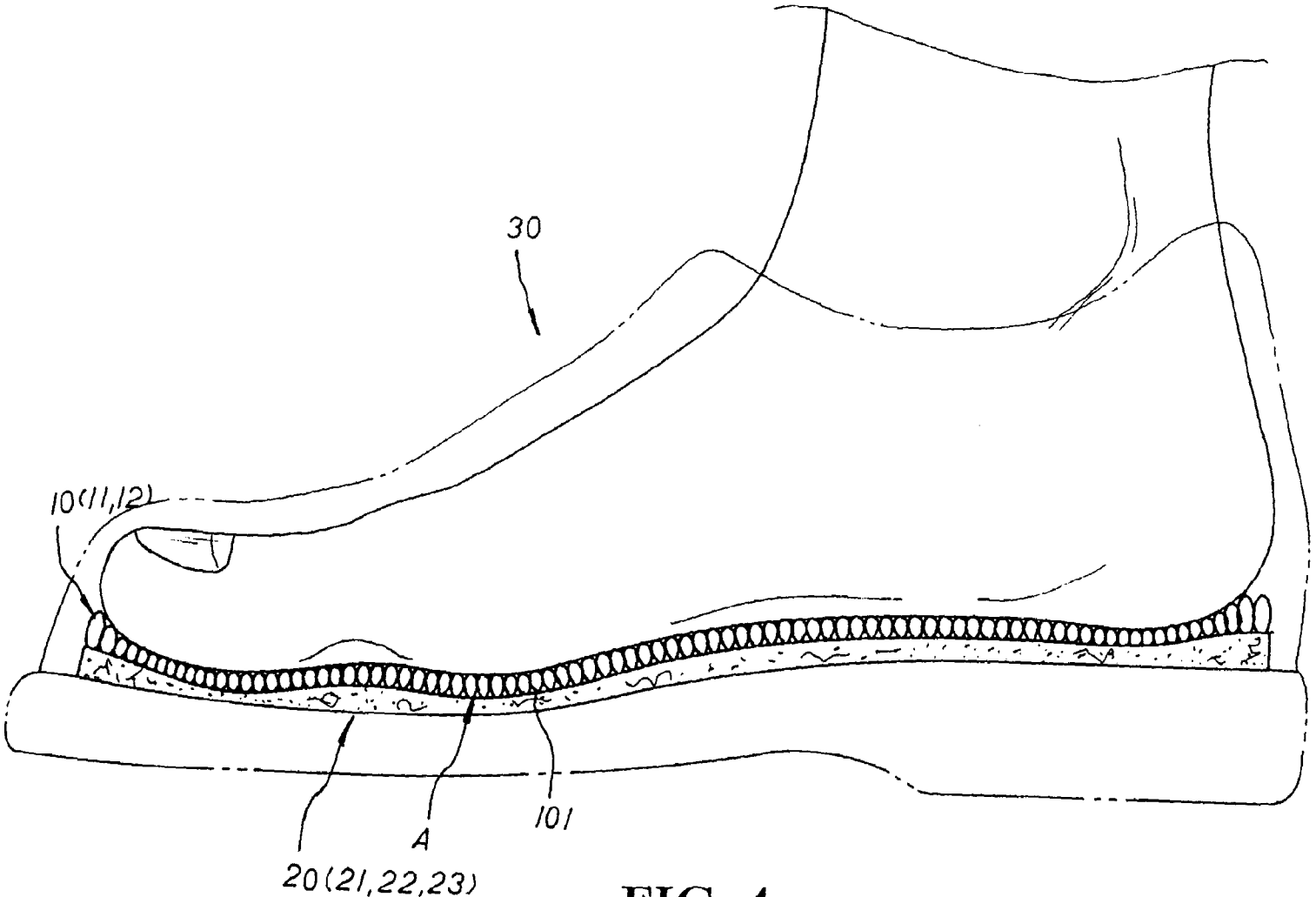
FIG. 4 is a diagram showing the present invention in practical use.

D. The upper and bottom layers 10, 20 with fastening agent applied onto the corresponding surfaces thereon are mutually bound together before pressed into insoles of various sizes and shoe shapes as shown in FIG. 3. When the finished insole thereof is located into the interior of shoes 30, the hollow support rings 101 of the upper layer 10 are able to sustain the weight of a sole A pressed downwards onto the insole thereof, generating a massage and airy effect as shown in FIG. 4. Via the bamboo charcoal powder 11, 22 added at the upper and bottom layers 10 therein 20, the insole thereof is equipped with strong absorbing capabilities as well as anti-bacteria, humid-adjustment, and deodorization effects.

What is claimed is:

1. A health-promoting insole made by the steps comprising:

mixing bamboo charcoal powder in a percentage of about 5% with about 95% of filament fibers to form a powder/filament mixture;

knitting and drawing the powder/filament mixture to form an upper layer having a plurality of hollow support rings densely arranged at the upper surface of the upper layer;

mixing bamboo vinegar liquid and bamboo charcoal powder in a ratio of about 1 to 2 to form a liquid/powder mixture;

drying the liquid/powder mixture by heating;

adding foaming material in a percentage of about 5% to about 10% to the liquid/powder mixture to form a bottom layer;

binding the upper and bottom layers together with a fastening agent;

cutting the bound upper and bottom layers into the shape of a shoe insole, wherein the upper and bottom layers are configured for absorbing moisture, deodorizing, and being anti-bacterial.

2. The health-promoting insole as claimed in claim 1 wherein the filament fibers are made of an oxford single filament.

3. The health-promoting insole as claimed in claim 1 wherein the foaming material is an EVA foaming material.

4. The health-promoting insole as claimed in claim 1 wherein the foaming material is a PU foaming material.

* * * * *